United States Patent [19]

Chatenay

[11] 4,207,713

[45] Jun. 17, 1980

[54] MODULAR SPACE STRUCTURATION DEVICE

[76] Inventor: Catherine M. Chatenay, "L'Etang", Martigne-Briand, France, 49340

[21] Appl. No.: 4,074

[22] Filed: Jan. 17, 1979

Related U.S. Application Data

[63] Continuation of Ser. No. 833,161, Sep. 14, 1977, abandoned.

[30] Foreign Application Priority Data

Oct. 1, 1976 [FR] France ..... 76 29515

[51] Int. Cl.[2] ..... E04H 3/12

[52] U.S. Cl. ..... 52/9

[58] Field of Search ..... 52/8, 9, 10; 108/1, 108/5, 7, 8, 9; 182/144, 184

[56] References Cited

U.S. PATENT DOCUMENTS

| | | | |
|---|---|---|---|
| 1,949,099 | 2/1934 | Burman | 248/439 |
| 3,288,421 | 11/1966 | Peterson | 248/396 |
| 3,653,715 | 4/1972 | Geffers | 108/144 |

*Primary Examiner*—John E. Murtagh

*Attorney, Agent, or Firm*—Merriam, Marshall & Bicknell

[57] ABSTRACT

The present invention relates to a modular space structuration device enabling open or closed spaces to be rapidly arranged for accommodating a large number of persons. Modules comprise a platform provided with seats and supported by compasses, each leg of the compasses being pivoted at its lower part on telescopic strut members of variable length, themselves pivoted at their upper end on said platform. One application of the present invention is the temporary installation of grandstands, theatres, tiers, amphitheatres etc.

10 Claims, 5 Drawing Figures

MODULAR SPACE STRUCTURATION DEVICE

This is a continuation of application Ser. No. 833,161, filed Sept. 14, 1977, now abandoned.

The present invention relates to a modular device intended particularly but not exclusively for rapidly arranging enclosed or open spaces where a certain number of persons will be assembled for public meetings, theatrical performances or the like.

In a known device, a platform, provided with independent lifting means carried by a member in the form of compasses, is characterised in that the fulcrum of the lifting forces of said platform is very close to its centre of gravity, so that it rises or descends in balanced position on a pivot. This particularity is advantageous insofar as the placing into work position may be effected by hand when the platform has been raised, this position being ensured by means added at that moment and which consist of chains and struts. However, apart from the necessity of resorting to supplementary means which may sometimes raise problems of maintenance, the forces to be applied to the raising of the platform, at the moment when it passes from low to high position by closure of the compasses, are very considerable, this leading to the use of over-sized lifting means or to the platform, in folded position, being of relatively great height. The direction of application of the lifting or raising forces of the platform is such that the compasses cannot be completely open, this being translated by a sometimes inacceptable bulk. Now, the height of the folded platform is an important element in the choice of the consumers. Moreover, the raising of a platform of one to two tons in equilibrium may raise problems of safety.

The present invention has for its object a platform overcoming the above-mentioned drawbacks, whilst conserving the advantages of the known device.

In accordance with the present invention, the platform mounted on supports forming compasses, themselves pivoted near the centre of gravity of said platform, is characterised in that each leg of said compasses is pivoted at its lower part on telescopic strut members of variable length, themselves pivoted at their upper end on said platform.

The length of the struts is advantageously controlled by one or more jacks, preferably screw jacks.

The device for lifting the platform is thus constituted by two deformable triangles and the self-stabilised platform has no need of supplementary bracing members.

Whilst the compasses are pivoted below the platform, the struts are advantageously pivoted on the upper part thereof, so that when the legs of the compasses form an angle of 180°, the struts form with the surface of the platform an angle of a few degrees allowing it to be raised.

The invention will be more readily understood on reading the following description with reference to the accompanying drawings, in which.

Figure 1:
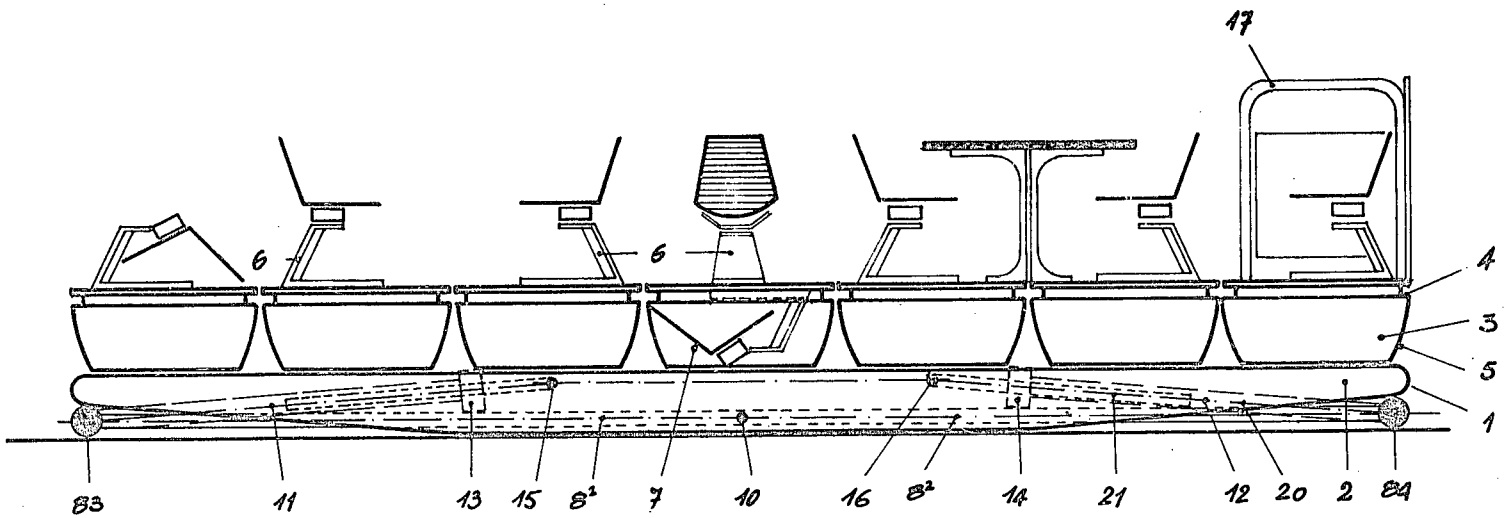
FIG. 1 is a view in elevation of the platform in folded position.

Referring now to the drawings, FIG. 1 shows the platform according to the invention which comprises a rectangular frame 1, constituted by two supports 2, only one of which is visible in the Figure, connected by at least two cross-pieces (not shown). The supports 2 bear containers or tubs 3 perpendicular thereto. The tubs are of truncated, hemicylindrical section, and their upper surfaces 4 are substantially contiguous, so that, in rest position, they form a continuous flat surface, and, in working position, a succession of tiers 4 separated by the side walls 5 of the tubs 3 (cf. FIG. 4).

The tubs 3 may contain seats 6 which may be arranged on the tiers by pivoting the upper surface thereof about a median axis. The folded position of a seat is shown at 7 in FIG. 1.

The frame or support frame 1 is borne by two compasses 8, only one of which has been shown, in broken lines, in FIG. 1, said compasses 8 comprising two legs 81 and 82 pivoted on a fork joint 10. Each leg of the compasses virtually forms part of a compass frame. In FIG. 1, the compasses are completely open. The free ends 83 and 84 of the legs are mounted on wheels 9 which enable the compasses 8 to open and close. On the spindles of the wheels are pivoted the lower ends of the struts 11 and 12. There are two pairs of struts, but only one has been shown in the Figure, in broken lines. As for the compasses, each strut is part of a strut frame comprising two struts connected by cross-pieces. Strut 11 is pivoted at 83 on the one hand and, on the other hand, at 15 on the support. The strut 11 is, in practice, constituted by a section 18 of fixed length inside which is housed a screw 19 which constitutes the section of variable length of the strut. The length of the variable section is controlled by a screw jack 13. In the same way, the strut 12, pivoted at 84, is also pivoted at 16 on the support. It is composed of a section 20 of fixed length and of a screw 21 partially penetrating said section 20, under the influence of jack 14. A railing 17 has been shown which is fixed in conventional manner on the edges of the tiers, for safety purposes.

Figure 2:
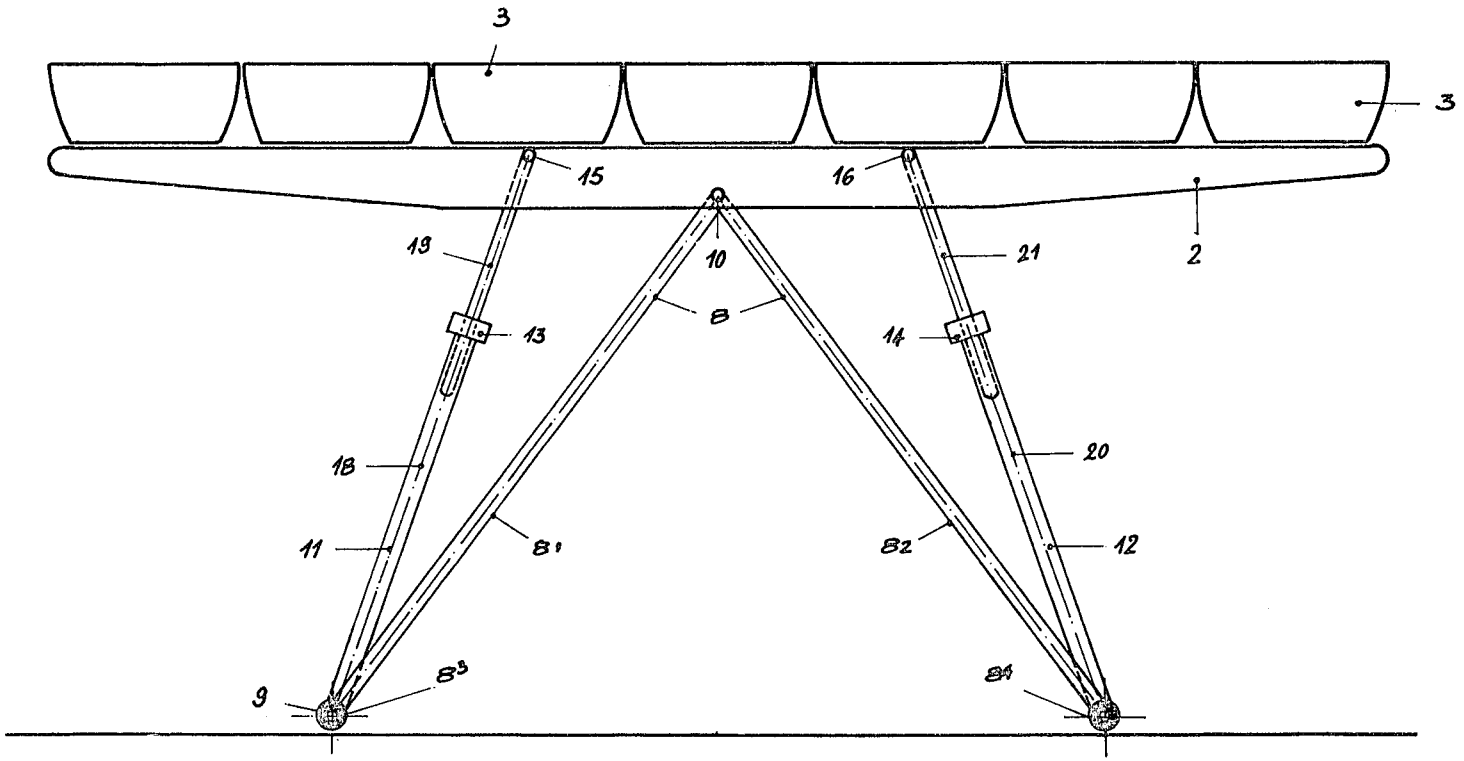
FIG. 2 is a view in elevation of the platform in high, horizontal position.

From the low position shown in FIG. 1, the process of raising the platform is clearly visible in FIG. 2. The screw jacks 13 and 14 are driven by a rotary movement of the motors (not shown in the Figure) so that the screws 19 and 21 extend out of sections 18 and 20 respectively. The length of the struts 11 and 12 increases, this causing the platform to rise and the compasses close. The lifting means are therefore not carried by the compasses but by the struts. The thrust force is made by the jacks of the struts and the legs of the compasses now work only in traction, when the platform is being raised.

The legs of the compasses consequently play an essential role in the necessary rigidity when used for ensuring stability of the platform. It will be noted that, contrary to what exists in conventional hoisting systems, which employ a fixed ground support, the ground support is obtained, according to the invention, by wheels which participate in the raising and lowering of the platform.

Figure 3:
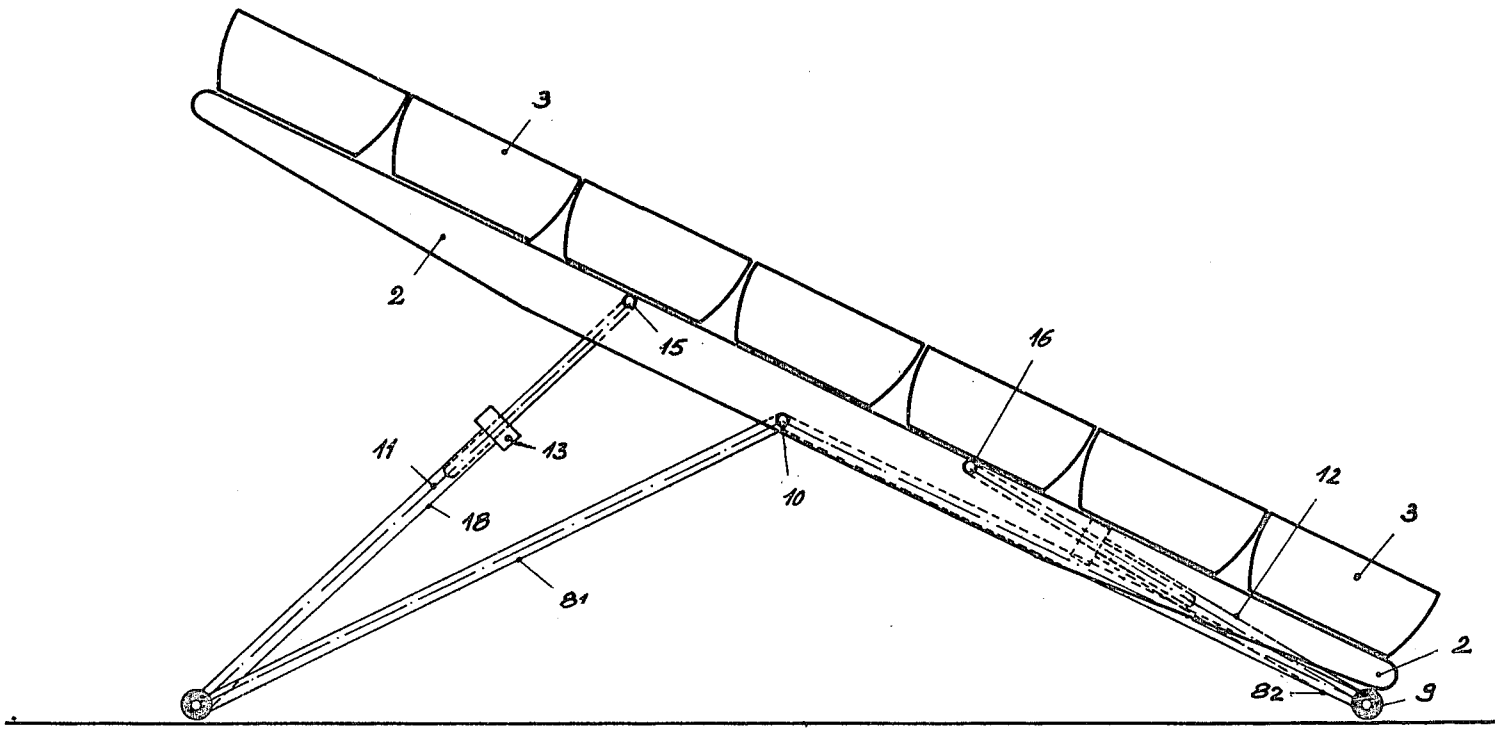
FIG. 3 is a view in elevation of the inclined platform.

The jacks being identical, the platform rises into horizontal position if the drive speed of the motors is the same on each side. To obtain the inclined position shown in FIG. 3, it suffices either to control only the left-hand jacks, starting from the position of FIG. 1, or to actuate the right-hand jacks, starting from FIG. 3.

Figure 4:
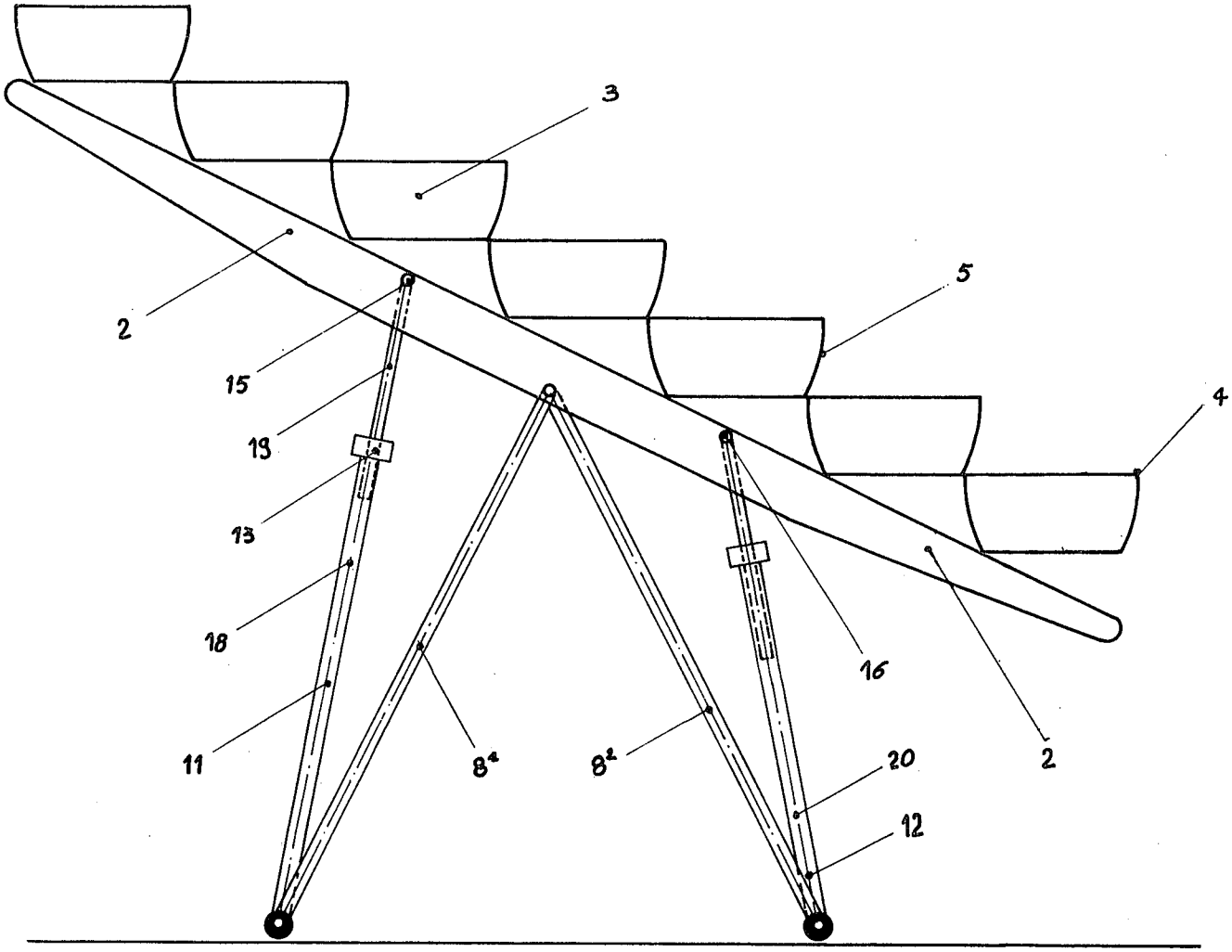
FIG. 4 is a view in elevation of the platform whose tiers are in horizontal position.

FIG. 4 shows the platform in an intermediate position, the tiers having been brought into position of use.

Figure 5:
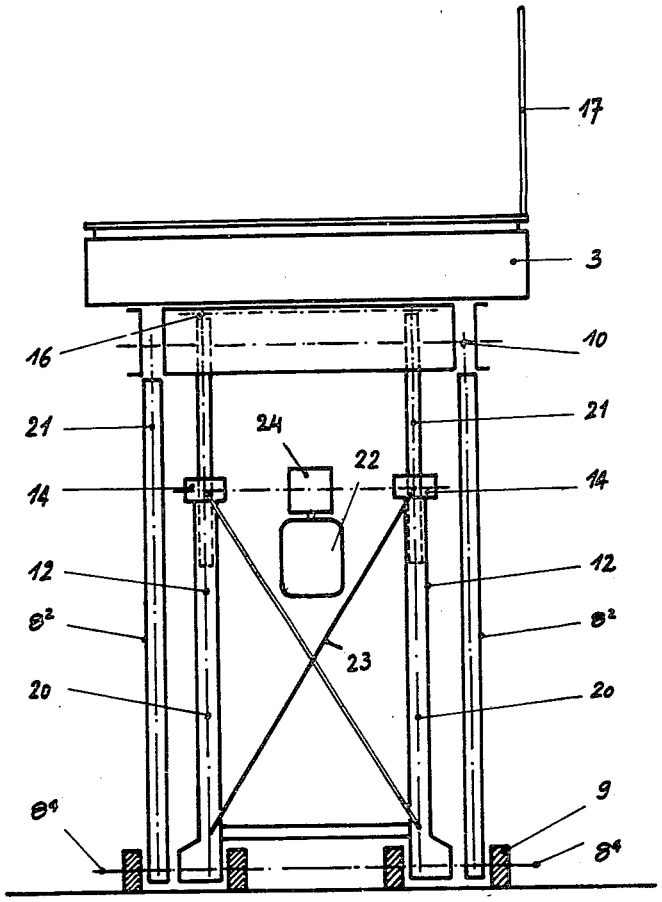
FIG. 5 is a side view of the platform.

FIG. 5 shows more clearly the structure of the lifting device, which is perfectly symmetrical, the different parts having identical references. The motor 22 for driving the jacks, shown schematically, is disposed in the centre of the struts which are connected by cross-pieces 23. The motor 22 rotates, via a bevel gear 24, the jacks 14 which cause the screws 21 to rise or descend outside or inside the cylinders 12. The motor 22 is fixed to the frame 12, 23 by any suitable means.

Preferably, the struts are pivoted at their upper part on the platform symmetrically with respect to the centre of gravity thereof, the two pivots being distant from each other by about $\frac{1}{3}$ of the length of the platform. Furthermore, the length of the legs of the compasses may be substantially equal to one half of the length of the platform.

What I claim is:

1. A modular space structuration device comprising:

a platform including a generally rectangular frame formed of two spaced elongated parallel support members interconnected by at least two spaced cross-pieces, a plurality of elongated tubs transversely arranged in side-by-side relationship on and supported by said support members, each of said tubs having a substantially flat upper surface and a truncated hemi-cylindrical cross-section, said tubs being rotatable relative to said frame, from a position in which said upper surfaces form a continuous flat surface to a position in which said tubs form a plurality of tiers projecting from said frame;

at least one compass for supporting said platform, said compass having two legs both of which are pivoted at their upper extremities to said platform at single point which is substantially the mid-point of the length of said platform;

a plurality of strut members of variable length, each strut member being pivoted at one of its ends to said platform and at its other end to the lower end of a leg of said compass, and means for varying the length of said strut members.

2. A device as claimed in claim 1, wherein said struts are pivoted at their upper part on the platform, symmetrically with respect to the centre of gravity thereof, the two pivots being distant from each other by about $\frac{1}{3}$ of the length of the platform.

3. A device as claimed in either of claims 1 or 2, which includes a pair of said compasses, each of which is pivoted at its upper extremity to a point adjacent an opposite side edge of said platform, each leg of one of said compasses and the strut member associated therewith being interconnected with the corresponding leg and strut member respectively of the other compass, whereby said legs and said strut members form rigid frames having a width substantially equal to the width of said platform.

4. A device as claimed in claim 1, wherein each telescopic strut forms a screw jack.

5. A device as claimed in claim 1, wherein the length of the legs of the compasses is substantially equal to one half of the length of the platform.

6. A device as claimed in claim 1, wherein the pivot point of the compasses on the platform is at a level lower than the pivot points of the telescopic struts on said platform, so that when the legs of the compasses form an angle of 180°, the struts form with the surface of the platform an angle of a few degrees allowing it to be raised.

7. A device as claimed in claim 6, wherein, in folded position, the legs of the compasses form an angle of 180°, the struts forming with the plane of the platform an angle of about 6°.

8. A device as claimed in claim 1, wherein said tubs are hollow.

9. A device as claimed in claim 8, in which the upper surface of each tub is pivoted for rotation about a median axis.

10. A device as claimed in claim 9, including at least one seat attached to one of said upper surfaces, which seat can be stored within said tub by rotation of said surface.

* * * * *